United States Patent [19]

Santandrea et al.

[11] 4,195,838

[45] Apr. 1, 1980

[54] ELECTRONIC GAME WITH VARYING EVENT PROBABILITIES

[75] Inventors: Joseph F. Santandrea, Sunnyvale; Daniel Schell, Los Gatos, both of Calif.

[73] Assignee: Monosil, Incorporated, Santa Clara, Calif.

[21] Appl. No.: 876,510

[22] Filed: Feb. 9, 1978

[51] Int. Cl.[2] ..... A63F 9/00

[52] U.S. Cl. ..... 273/88; 273/85 G

[58] Field of Search ..... 273/88, 1 E, 93 R, 93 C, 273/85 G, 85 R

[56] References Cited

U.S. PATENT DOCUMENTS

| | | | |
|---|---|---|---|
| 2,495,620 | 1/1950 | Werle et al. | 273/88 |
| 2,769,639 | 11/1956 | Seale | 273/93 R |
| 3,874,669 | 4/1975 | Ariano et al. | 273/85 R |
| 4,060,242 | 11/1977 | Huang et al. | 273/1 E |

*Primary Examiner*—George J. Marlo

*Attorney, Agent, or Firm*—Limbach, Limbach & Sutton

[57] ABSTRACT

An electronic game having a capability to vary the probabilities of events happening to simulate choices that are made in actual games. A baseball electronic game is specifically described having a miniature baseball field representation with lights indicating positions of runners on the bases and a score board. The disposition of each batter is determined by random electronic generator. The batting average resulting from the generator can be altered for a short period of time by the players selecting a relief pitcher mode or a pinch hitter mode for one or a few batters and only for a few times during each game.

8 Claims, 3 Drawing Figures

ELECTRONIC GAME WITH VARYING EVENT PROBABILITIES

BACKGROUND OF THE INVENTION

This invention relates to an electronic game, and more particularly to the type of electronic game that simulates an actual sport and which may be played by two players.

Numerous electronic games exist or have been proposed that simulate actual individual or team sports such as baseball, football, soccer, tennis and the like. Such electronic games exist as self-contained stand alone units or are constructed for use in conjunction with a standard television set. It is a principal object of the present invention to provide a technique applicable to all such games to make them more real by including means for the players to make certain choices that exist in the actual game, particularly in a team sport game such as baseball.

SUMMARY OF THE INVENTION

This and additional objects are accomplished by the present invention wherein, briefly, probabilities of certain events occurring in response to player initiation is set to simulate that which occurs in the real life game and this proability is alterable by the players in making choices and following a strategy much like would occur in the real life sport. For example, in a baseball electronic game utilizing the present invention as described in detail hereinafter, the various possible batting events are possible in proportion to the real life probabilities and thus giving that batter a real life batting average. The batting average is temporarily variable throughout the course of the game, however, by provisions for simulating the introduction of a relief pitcher, which makes the batting average go down, and the use of a pinch hitter, which make the average go up. The batting averages are varied by altering the electronic probabilities of various batting events happening. The use of a relief pitcher or a pinch hitter is limited in each game. Each player then has these options to use at appropriate times in the game when the greatest advantage will be obtained. The result is an interesting electronic game wherein the skill of the player determines who wins.

Additional objects, advantages and features of the present invention will become apparent from the following description of a preferred embodiment thereof, which description should be taken in conjunction with the accompanying drawings.

DESCRIPTION OF A PREFERRED EMBODIMENT

Although the various aspects of the present invention have application to a number of different types of electronic games, the invention is described herein with respect to the accompanying drawings in the form of a baseball game that is competitively playable by two players, one representing each of two baseball teams.

One player is a "visitor" baseball team and the other player is a "home" team.

Figure 1:
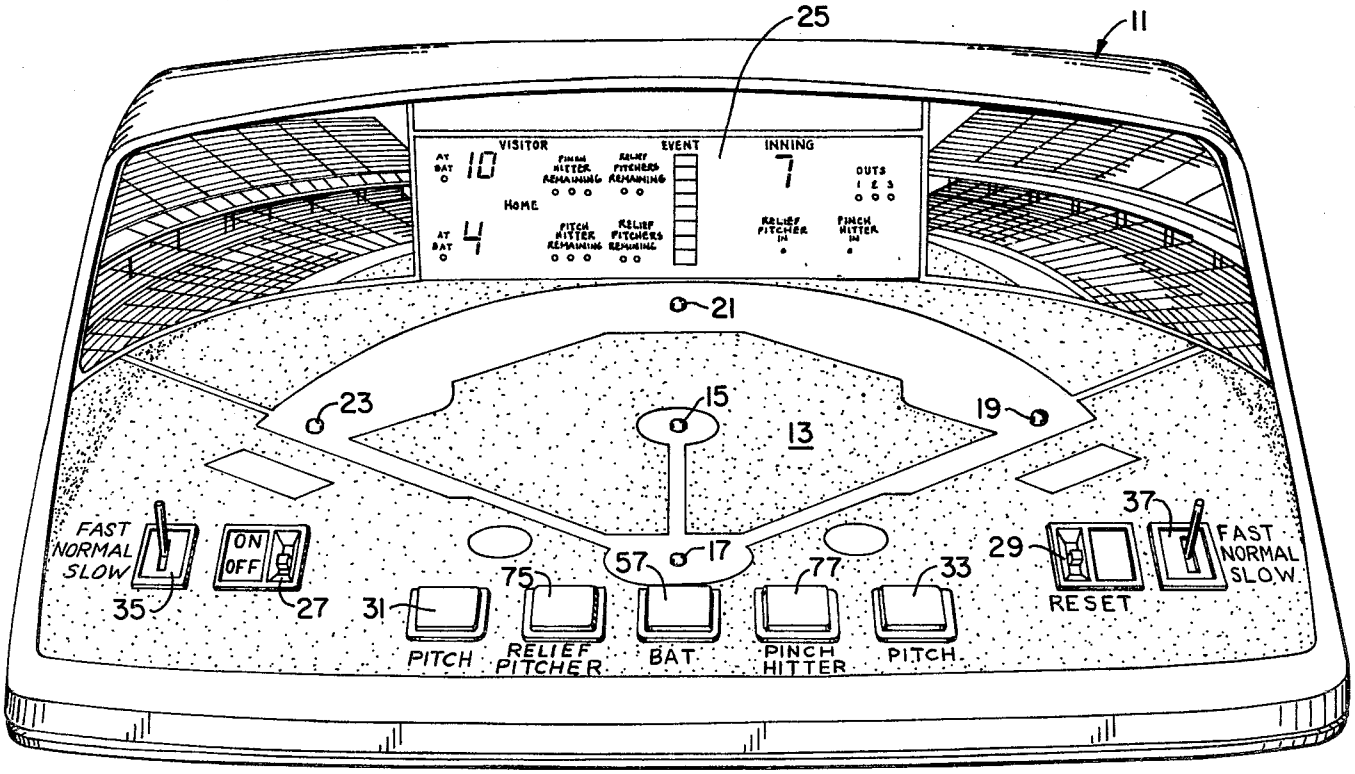
FIG. 1 shows an outside view of a baseball game apparatus which utilizes the various aspects of the present invention.
Figure 2:
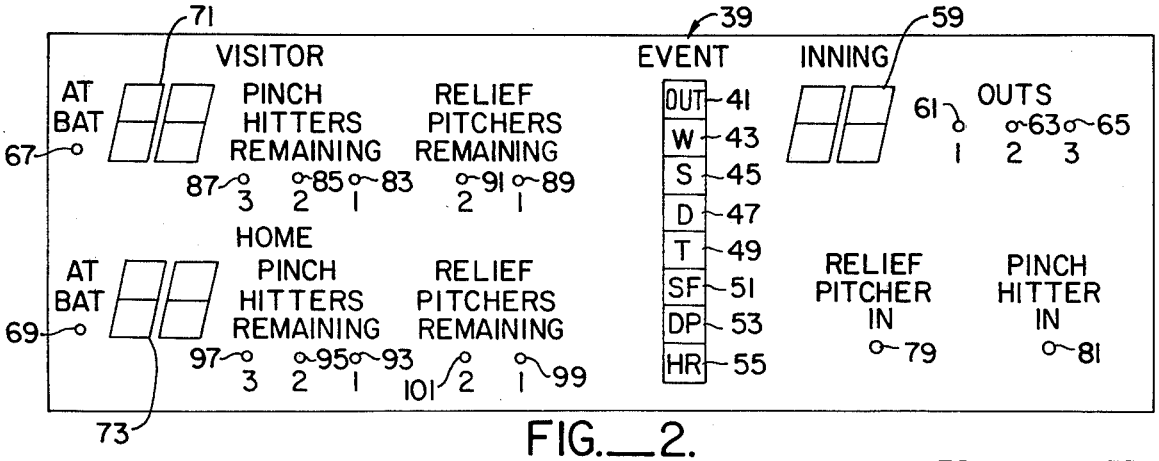
FIG. 2 is an enlarged view of the score board portion of FIG. 1.

Referring to FIGS. 1 and 2, the baseball game is housed in a table top case 11. A flat, gently sloping surface of the case includes a simulated baseball diamond 13 having a light 15 at the pitcher's mound, a light 17 at home base, a light 19 at first base, a light 21 at second base, and a light 23 at third base. A score board 25 is held substantially vertically. Several controls are provided at the front of the case 11, including a power switch 27 and a reset button switch 29 which starts a new game. A pitch is initiated by the player representing the team at field pushing either of two "pitch" buttons 31 and 33 provided on opposite sides of the case 11 for ease of access by either player. Controls 35 and 37 are also provided on either side of the case 11 for controlling the characteristics of the pitch, as described hereinafter. Each of the controls 35 and 37 is a spring loaded switch held at rest in a "normal" pitch position with optional "fast" and "slow" positions for use by the player that is causing the pitch to be initiated.

Once either of the pitch buttons 31 or 33 is pushed, a playing sequence is initiated that first causes certain batting events to be scanned. Referring to FIG. 2, a plurality of event lights 39 are provided on the score board 25 in a vertical row. The batting events provided are for the batter going out in some manner as indicated by a light 41, the batter walking as indicated by a light 43, the batter obtaining a single as indicated by the light 45, a double as indicated by the light 47, a triple as indicated by the light 49, the hitting of a sacrifice fly as indicated by the light 51, the hitting into a double play as indicated by the light 53, and obtaining a home run as indicated by the light 55. The pushing of one of the buttons 31 and 33 causes the internal electronics to scan between these various batting event possibilities and the event lights 39 so indicate this scanning by alternately turning on and off. The batting event that is selected at the instant that a "bat" button 57 (FIG. 1) is pushed determines the event for that batter. The speed of scanning the various event possibilities is controlled by the switches 35 and 37 and this gives some added uncertainty to the batter as to the sequence of possible batting events that are being cycled by the electronics. Otherwise, a batter may, from experience in extensively playing the game, be able to anticipate the timing of certain batting events.

The score board 25 includes a number of other display lights. The inning of play is digitally displayed by a two digit LED display 59 the number of outs that exist are shown by single LED lights 61, 63 and 65. The player team that is at bat is indicated by the lights 67 and 69. The light 67, when lighted, shows that the "visitor" team player is at bat. That team's score is shown by a two digit digital display 71. Similarly, the "home" team player has its score indicated by a two digit digital display 73 with the light 69 indicating when that team is at bat.

The possible batting events that are scanned by the electronics and displayed on the event lights 39 are weighted in approximate correlation with real life baseball probabilities. That is, the probability that a player at bat will go out upon pressing the bat button 57 is substantially the same as real baseball statistics. This is the same for the other events represented by the event lights 39. A batting average of 270 is simulated by this game. However, as in a baseball game, these probabilities may be altered somewhat by operation of a "relief pitcher" button 75 and a "pinch hitter" button 77. When the relief pitcher is in the game, the batting average drops to 200. When a pinch hitter is in the game, the batting average increases to 400. When both are in the game, the batting average remains at 270. The score board 25 (FIG. 2) includes a light 79 that lights when the relief pitcher has been placed in the game by pushing the button 75. A light 81 lights when a pinch hitter has been placed into the game by pushing the pinch hitter button 77. Through the system electronics, a pinch hitter remains in the game for five batters and then the probability automatically returns to the 270 batting average. A pinch hitter remains in only one batter and then the batting average returns to the general average of 270 for the next batter.

Each player of the game is restricted to using pinch hitters only three times during the game and relief pitchers only two times. A tabulation of the number of times that each of these options has been used is provided on the score board 25, as best illustrated in FIG. 2. Lights 83, 85 and 87 indicate whether one, two or three, respectively, pinch hitters remain to be used in the game by the "visitor" team player. Similarly, lights 89 and 91 indicate whether one or two relief pitchers remain to be used by the "visitor" team player. For the "home" team player, lights 93, 95 and 97 indicate the pinch hitters remaining and lights 99 and 101 indicate the number of relief pitchers remaining.

Figure 3A:
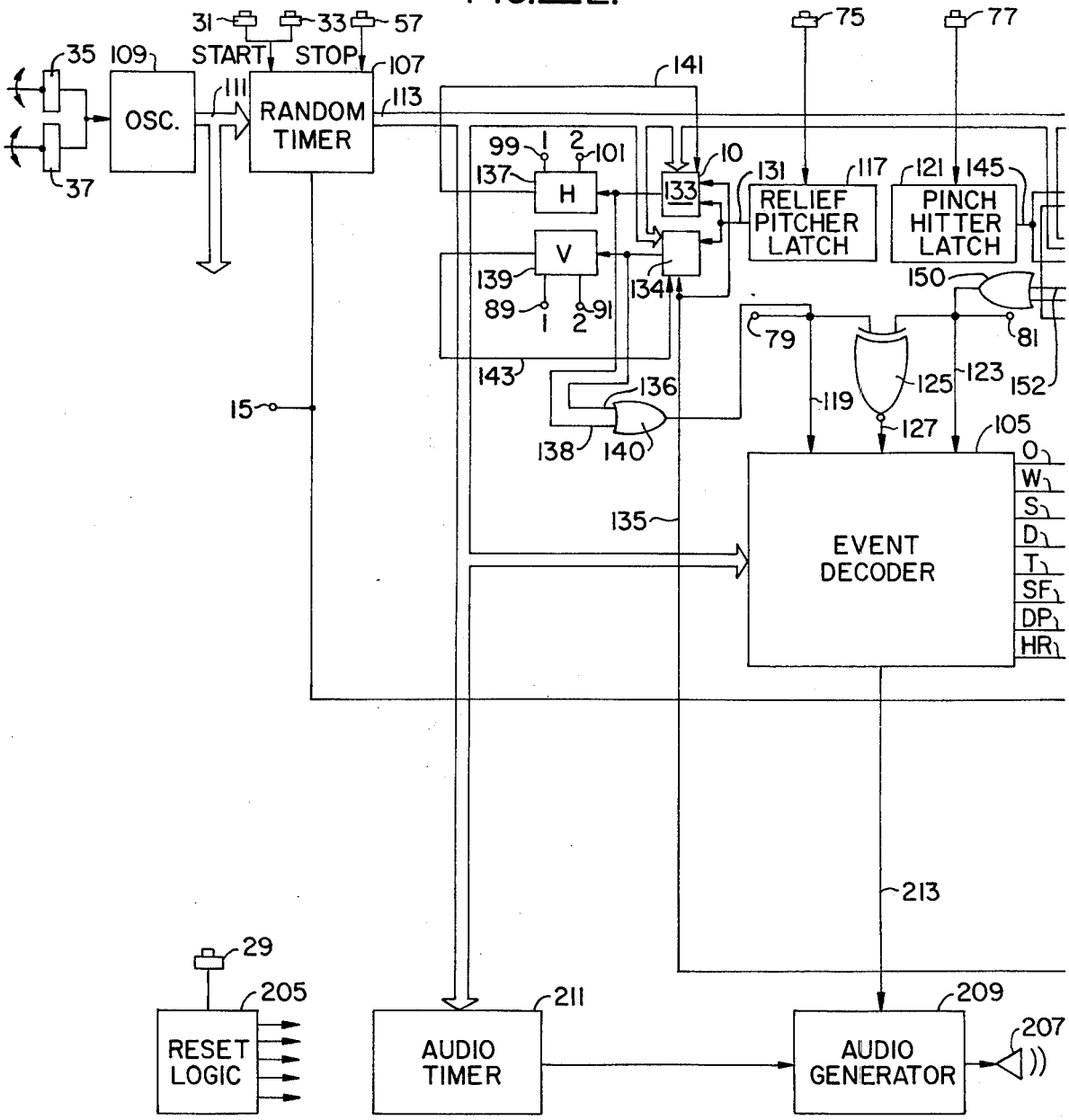
FIG. 3 is an electronic schematic block diagram of the circuits of the baseball game of FIGS. 1 and 2.
Figure 3:
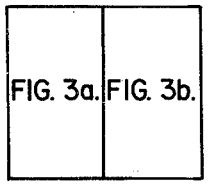
Figure 3B:
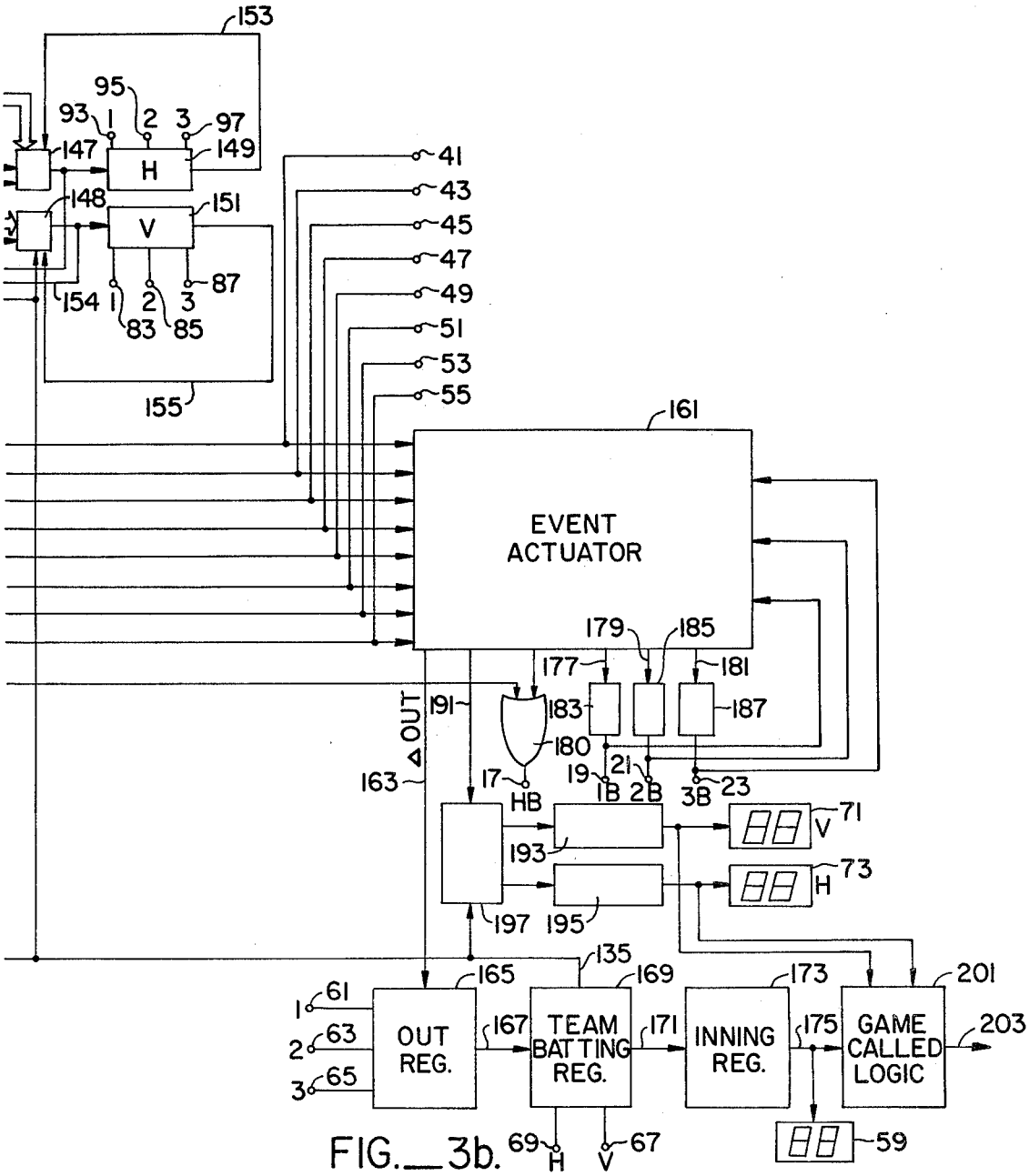

The electronic system within the game case 11 is schematically illustrated in block diagram form in FIG. 3 wherein the specific probabilities and altering thereof are also explained in more detail. The output lines of an event decoder 104 carry the out, walk, etc., batting events that are fed to the lights 41–55 on the panel 25 of the game. Changes in output occur randomly in these lines but their occurrance is weighted in accordance with the normal batting probabilities. Such sequencing of change in outputs through these lines is initiated by pressing either of the "pitch" buttons 31 or 33 and is stopped by pressing the "bat" button 57. When stopped, the sequencing circuitry leaves only one of these lines with a changed output and this determines what the batting event is.

Many specific types of electronic circuits could be employed for selecting the batting event in a manner outside of the complete control of the player, but the combination of a random timer 107 with the event decoder 105 is convenient and simple to implement. The random timer 107 is driven by an oscillator 109 that has a digital output in a line 111. The oscillator output not only drives the timer 107 but is also used as the timing signal that is applied to every other active circuit block. The frequency of the oscillator 109 is determined by the setting of either of the switches 35 or 37. When set in a "fast" position, the oscillator 109 increases in frequency output from the "normal" and when in a "slow" position, the output frequency decreases.

The random timer 107 includes a number of counter stages connected together to generate at a tweleve line digital output one number at a time in a random order in a range of one through thirty-six for the very specific example being described. That is, the output lines 113 carry in digital form a representation of one of the numbers from one through thirty-six at any given instance. This output is randomly changed between this group of numbers and that output is applied to the event decoder 105 in twelve input lines thereto. The principal element of the decoder 105 is a read only memory (ROM) made of a programmable logic array (PLA). The decoder 105 causes a change in the voltage level of one of the eight output lines of the decoder 105 for each of the numbers one through thirty-six in the input line 113. But the decoder 105 is set so that an output is the "0" batter out line occurs for more of the numbers from one through thirty-six than any other of the batting events. For a 270 batting average, the following table represents the weighting of outputs for the numbers inputted to the decoder 105:

| Event | Output Line | Number of the Numbers 1–36 That Cause the Output of Each Line |
|---|---|---|
| Out | 0 | 18 |
| Walk | W | 4 |
| Single | S | 4 |
| Double | D | 3 |
| Triple | T | 2 |
| Sacrifice Fly | SF | 2 |
| Double Play | DP | 2 |
| Home Run | HR | 1 |
| | | 36 Total |

It will be noted that this game does not keep track of every pitch but rather there is only one event for each batter. It will be noted from the table above that 50% of the time an out will be registered (18 of the 36 randomly generated numbers), a walk will be obtained in 11.1% of the time (a different 4 of the 36 randomly generated numbers), etc.

The implementation of the relief pitcher or pinch hitter variations of the game cause other inputs to the event decoder 105 to change and this changes the batting average expected from the batter. When the relief pitcher button 75 is pushed, a latch 117 causes the voltage in a line 119 to change and this is another input to the decoder 105. When the pinch hitter button 77 is pushed, a latching circuit 121 causes the voltage in a line 123 to change for a time and this is yet another input to the event decoder. Both of the lines 119 and 123 are connected to an inverting exclusive OR gate 125 having an output line 127 which is a final input to the event decoder 105. The decoder 105 is connected so that the probabilities of the individual various outputs of the decoder 105 are changed if either the relief pitcher or pinch hitter are put into the game, as follows:

| Output Line | Relief Pitcher Line 119 | Pinch Hitter Line 123 |
|---|---|---|
| 0 | 26 | 14 |
| W | 0 | 3 |
| S | 3 | 4 |
| D | 3 | 4 |
| T | 0 | 3 |
| SF | 2 | 2 |
| DP | 2 | 2 |
| HR | 0 | 4 |
| | 36 Total | 36 Total |

That is, if the line 119 is high because the relief pitcher latch 117 has been latched from pushing the button 75, 26 of the 36 different numbers inputted to the decoder 105 will cause the out "0" line output of the decoder 105 to change voltage level. Similarly, if a pinch hitter is put into the game and the voltage level in the line 123 is changed, 14 of the 36 input numbers will cause the output line "0" to change voltage level. If both the relief pitcher and pinch hitter are put into the game at the same time, the output of the OR gate 125 in the line 127 causes the outputs of the decoder 105 to revert to the normal 270 batting average mode of the first table given above.

An output 131 of the latch 117 is connected to switching circuits 133 and 134 which are provided for operating the "home" and "visitor" relief pitching circuits, respectively. A relief pitcher is permitted to stay in the game for only five batters and at the end of that time the voltage level in the line 119 returns to normal automatically. This is accomplished by connecting the switching circuits 133 and 134 to the output 113 of the random timer 107. The switching circuits 133 and 134 each contain a counter which notes when five starts and stops of the timer 107 have occurred for their respective "home" and "visitor" teams. Each of the switching circuits 133 and 134 are appropriately enabled by a signal in the line 135 that is indicative of which team is at bat. Separate "home" and "visitor" counters 137 and 139, respectively, receive signals from the switching circuits 133 and 134 to keep track of how many times each team has used the relief pitcher option. When either of the counters 137 or 139 reach the second state to indicate that the relief pitcher has been used by a certain team, an overflow signal is passed through one of the output lines 141 and 143 to their respective switching circuits 133 or 134 to disable that circuit from operating any further to provide a relief pitcher when that team is in the field. Outputs of the switching circuits 133 and 134 are applied to an OR gate 140 whose output is in line 119, previously described.

A similar system is provided in conjunction with the pinch hitter latch 121 wherein a change in its state is communicated by a line 145 to switching circuits 147 and 148 and thence to "home" and "visitor" counters 149 and 151, respectively, through overflow signal lines 153 and 155 back to their respective switching circuits 147 and 148 to disable them from further operation when the team who has exhaused its three pinch hitters is at bat. The switching circuits 147 and 148 are also connected to the output lines 113 of the random timer 107 and this causes their outputs to return back to a normal voltage level once the timer 107 has been started and stopped a single time. Outputs of the switching circuits 147 and 148 are applied to an OR gate 150 whose output is in line 123, previously described.

In order to accummulate information about each of the teams, an event actuator 161 receives all of the eight output lines of the event decoder 105. The event actuator 161 is also a read only memory formed of a programmable logic array. Whenever there is an out through a signal in any of the "0," "SF" or "DP" output lines of the decoder 105, a signal is generated in an output line 163. In fact, in the case of a double play, sequential signals are generated in the line 163 to indicate two outs. This signal increments an "out" register 165 that generates an overflow signal in the line 167 after three outs have been received. This overflow changes the state of a two state team batting register 169. Its output is connected to the line 135 whose binary state gives an indication of which team is at bat. After both teams are at bat, an output signal in the line 171 is applied to an inning register 173 that has an output 175 that is an indication of the present inning of play at all times.

Lines 177, 179 and 181 that are outputs of the event actuator 161 occur when a man has been placed on first base, second base or third base, respectively. These signals are applied to individual latches 183, 185 and 187 whose outputs are both fed back to the event actuator 161 as three additional inputs and also applied to the individual base lights 19, 21 and 23. The ROM of the event actuator 161 will, as an example, turn off the first base light 19 and turn on the second base light 21 in response to a sacrifice fly by a batter which is represented by a change in voltage level in the "SF" line output of the event decoder 105. Since the event acutator 161 knows at the beginning of the play that the first base latch 183 is activated, a sacrifice fly will cause that runner to automatically move from the first base to the second base by unlatching the latch 183 and latching the latch 185.

Another output line 191 from the event actuator 161 emits a signal whenever a run has been scored. These runs are accummulated either in a "visitors" register 193 or a "home" team register 195, depending upon the state of a switch 197. The switch 197 operates in response to a signal in the line 135 that indicates which team is at bat. The outputs of the counters 193 and 195 are applied to the score display 71 and 73.

A logic circuit 201 receives the inning information from the inning register 173 and emits a signal in an output line 203 that is utilized to stop the game once nine innings have been played so long as the score as detected from the outputs of the counters 193 and 195 is not tied. If the score is equal at the end of nine innings, the game is permitted to play until some maximum number of innings occur or until the tie score is broken at the end of an inning. An OR gate 180 receives a signal from the event actuator 161 when a run scores.

The reset button 29 initiates reset logic 205 that changes state of nearly all of the blocks discussed heretofore. All of the counters are reset to zero, the registers set to place the visiting team at bat, innings to the first inning, outs to zero, relief pitcher and pinch hitter counters to zero, etc.

As an additional feature, sounds are generated through a loud speaker 207 that is part of the game. An audio generator 209 operates in response to a timer 211 and a signal in a line 213 from the event decoder 105. The voltage level in the line 213 is either in one state when a favorable event has occurred after a batter, such as a double, home run, etc., and is in another state when an unfavorable event occurs, such as an out or double play. The audio generator 209 is capable of emitting a buzzer like sound in response to the unfavorable event signal and a cheer in response to a favorable event signal. The timer 211 permits the audio generator 209 to emit a signal to the loud speaker 207, in any event, only for a short time after the random timer has been started and stopped as detected by connection to the line 113.

The various aspects of the present invention have been described in particular detail to a baseball game but it will be understood that the principals embodied herein are applicable to other types of games as well. It will be understood that the invention is entitled to protection within the full scope of the appended claims.

We claim:

1. An electronic game version of a two team sport, comprising:

means responsive to initiation by a player for randomly selecting one of a plurality of distinct electrical signals, means receiving said selected electrical signal for generating each of a plurality of distinct event signals in response to an exclusive number of said distinct electrical signals, whereby the probability of a given event signal occurring depends upon the number of exclusive electrical signals to which the given event signal responds in proportion to the total number of signals that cause any event signal to occur, and means responsive to player control for altering at least some of the probabilities within said generating means for less than all of the game.

2. The electronic game according to claim 1 wherein said probability altering means is operable for only a few player initiations of said random selection means, and further wherein said probability altering means additionally comprises means for counting the number of times during a game that each player utilizes said probability altering means.

3. An electronic baseball game for playing by two players, comprising:

means responsive to initiation of the player at bat for randomly determining with set probabilities a particular batting event, and means responsive to player control for temporarily altering the probabilities for only a few times at bat and for only a set number of times per game.

4. An electronic baseball game according to claim 3 which additionally comprises a minature baseball field layout having energizable lights at first, second and third bases, and means responsive to said random selection means for energizing said base lights to indicate where base runners exist at all times.

5. The electronic baseball game according to claim 3 wherein said probabilities are set in accordance with actual average player batting averages and wherein said altering means comprises means for changing the probabilities downward for at least several pitches to simulate the effect of a relief pitcher, and means for altering the probabilities upward for a single batter to simulate the substitution of a pinch hitter.

6. An electronic baseball game for playing by two players, comprising:

a random generator of a plurality of different digital signals at an output over time, means responsive to player action for starting said random generator and stopping it, whereby one of the digital signals is randomly selected at the output, decoding means receiving said digital signals at said output for generating one of a number of batting event signals in response to one or more unique digital signals from said random generator, whereby the number of digital signals that causes generation of each batting event signal providing a probability of that event occurring when said random generator is stopped, means including said decoding means for selectively controlling the number of digital signals that causes generation of each batting event signal, said controlling means also including means responsive to player initiation for changing said number of signals for each batting event from a normal number to a different number for a fixed number of starting and stopping cycles of said random generator.

7. The game according to claim 6 wherein said controlling means includes means for limiting the number of instances in each game wherein said changing means is operative.

8. The game according to claim 6 which additionally comprises means receiving said batting event signals for accumulating batting events and team scores in accordance with the simulated baseball game.

* * * * *